US005899761A

United States Patent [19]

Crane et al.

[11] Patent Number: 5,899,761

[45] Date of Patent: May 4, 1999

[54] POWER STRIP

[75] Inventors: John J. Crane, Ramona, Calif.; Walter M. Bailey, Zanesville, Ohio

[73] Assignee: Fiskars Inc., Madison, Wis.

[21] Appl. No.: 09/065,550

[22] Filed: Apr. 24, 1998

Related U.S. Application Data

[63] Continuation-in-part of application No. 08/927,195, Sep. 11, 1997.

[51] Int. Cl.[6] ..... H01R 13/44

[52] U.S. Cl. ..... 439/142; 439/654

[58] Field of Search ..... 439/136, 142, 439/144, 650–654, 954; 174/48, 67; 200/51 R; 361/643; D13/147, 156

[56] References Cited

U.S. PATENT DOCUMENTS

| | | | |
|---|---|---|---|
| D. 194,870 | 3/1963 | Hill | D26/1 |
| D. 210,377 | 3/1968 | Lopez-Fabrego | D13/147 |
| D. 299,821 | 2/1989 | Dively | D13/31 |
| D. 301,576 | 6/1989 | Wang | D13/30 |
| D. 369,784 | 5/1996 | Pogue et al. | D13/160 |
| 4,154,499 | 5/1979 | Weber | 339/193 |
| 4,627,684 | 12/1986 | D'Amato | 339/206 |
| 4,838,814 | 6/1989 | Takai et al. | 439/620 |
| 4,864,078 | 9/1989 | Bowman | 439/142 |
| 4,984,982 | 1/1991 | Brownlie et al. | 439/131 |
| 5,195,288 | 3/1993 | Penczak | 52/220 |
| 5,285,009 | 2/1994 | Bowman et al. | 174/48 |
| 5,383,799 | 1/1995 | Fladung | 439/652 |
| 5,649,839 | 7/1997 | Yu | 439/650 |
| 5,748,424 | 5/1998 | Hung | 439/652 |

*Primary Examiner*—Neil Abrams
*Assistant Examiner*—Brian J. Biggi
*Attorney, Agent, or Firm*—Foley & Lardner

[57] ABSTRACT

An electrical connector includes a base, a contact housing plate and a cover. The contact housing plate is coupled to the base and includes an electrical receptacle which is adapted to engage an electrical plug. The cover is also coupled to the base and overlies the contact housing plate. The cover has an inclined surface which extends toward the base and an opening therein forming a recess for receiving the electrical plug that is engageable with the electrical receptacle. The cover also includes a lid, which is movable between an open position and a closed position. When the lid is in the open position, the contact housing plate is exposed, facilitating access to the electrical receptacle. When the lid is in the closed position, the lid protects the electrical plug from debris and dislodgement from the electrical receptacle. The electrical connector may further include a plurality of electrical receptacles and openings for receiving multiple electrical plugs. The electrical connector may also include a circuit board which may contain an on/off switch and a circuit breaker with surge suppression. In addition, the plug of the power cord for the electrical connector may contain a built-in GFCI circuit.

20 Claims, 6 Drawing Sheets

POWER STRIP

CROSS-REFERENCE TO RELATED APPLICATION

The present application is a continuation-in-part of U.S. patent application Ser. No. 08/927,195, filed on Sep. 11, 1997.

FIELD OF THE INVENTION

This invention relates to an electrical connector, such as a power strip or a power strip with a surge protector having a plurality of receptacles or outlets for receiving electrical plugs of various appliances. More particularly, the present invention relates to a multiple outlet electrical connector in which the outlets are recessed in a cover, thereby protecting the connections between the electrical plugs and the outlets. The present invention further relates to an electrical connector in which the outlets are preferably inclined toward a base of the connector. The orientation of the outlets directs cords attached to the electrical plugs toward the ground, further stabilizing the electrical connector and preventing the cords from forming unwanted loops.

BACKGROUND OF THE INVENTION

In general, power strips and surge protectors, which enable a number of electrical appliances to be connected to a single power source, are well known. The most common power strip includes an elongate strip with a plurality of outlets aligned in a single row along a top surface of the strip. Each outlet is configured to receive an electrical plug of an appliance. When coupled to the power strip, the plug extends upward, transverse to the top surface. The power strip or surge protector may further include a power switch and a circuit breaker also located on a surface of the strip.

Power strips of this type have several disadvantages. First, since the outlets are located along the top surface of the strip and lack any sort of cord management feature, the cords of attached electrical plugs project upward from the strip and are prone to creating loops on which people may trip or objects may be snagged. If the power strip is stepped on, connections between the electrical plugs and their respective outlets may become fully or partially dislodged. When a plug is fully dislodged from the outlet, the connection is broken, cutting off power to the appliance. A partially dislodged plug exposes the metal prongs of the plug which may come into contact with living things and cause electrical shock. In addition, partially dislodged plugs are prone to bending, disfigurement or breakage. Second, metal shavings, filings and dirt may affect the integrity of the uncovered outlets. Falling metal shavings and filings, in particular, may short the circuit and cause an electrical fire.

Another type of power strip has a trapezoidal cross-section. This power strip includes two rows of outlets, each row located on an inclined surface of the trapezoid, with the outlets facing upward. The orientation of these outlets also encourages the cords of attached plugs to project upward and to form dangerous loops. A plug with its cord extending upward and forming a loop is susceptible to being detached from the connector. In addition, the outlets of this power strip are uncovered, leaving them exposed to falling metal shavings, filings and dirt, such as sawdust.

In light of the foregoing, it is desirable to provide an attractive electrical connector in which the electrical receptacles or outlets, and also the connections between plugs and the receptacles, are protected from the environment and from being stepped on or dislodged. In addition, it is desirable to provide an electrical connector that is stable even when several plugs are coupled to the connector and run in different directions. Another desirable feature of the electrical connector is a system for organizing the cords of electrical plugs attached to the connector.

SUMMARY OF THE PRESENT INVENTION

An electrical connector constructed in accordance with the present invention includes a base, a contact housing plate and a cover. The contact housing plate is coupled to the base and includes a front face and an electrical receptacle which is adapted to engage an electrical plug. The cover is also coupled to the base and overlies the contact housing plate. The cover includes an inclined surface which extends toward the base and has an opening therein. The opening forms a recess that is adapted to receive the electrical plug which is engageable with the receptacle. The cover further includes a lid connected thereto. The lid is movable between an open position, in which access to the electrical receptacle is facilitated, and a closed position, in which the electrical plug is covered and protected.

In accordance with another aspect of the invention, an electrical connector is provided with a base and a contact housing plate as described above. The electrical connector also includes a cover. The cover, which is coupled to the base and overlies the contact housing plate, has a vertical surface and an inclined surface. The vertical surface is adapted to rest flush against a vertical wall, while the inclined surface extends toward the base. An opening in the inclined surface forms a recess which is adapted to receive the electrical plug. The cover further includes a lid, which is movable between an open position and a closed position. The open position of the lid facilitates access to the electrical receptacle of the contact housing plate, and the closed position of the lid protects the electrical plug.

In accordance with still another aspect of the invention, an electrical connector includes a base, a contact housing plate and a cover. The contact housing plate is coupled to the base and includes a front face, which is inclined toward the base, and an electrical receptacle, which is adapted to engage an electrical plug. The cover is coupled to the base and further includes a planar top surface and an inclined surface extending toward the base. The inclined surface has an opening therein which forms a recess for receiving a cord associated with the electrical plug. The cover also includes a lid pivotally connected thereto. The lid is movable between an open and a closed position. In the open position the lid facilitates access to the electrical receptacle. In the closed position the lid protects the electrical plug.

Other principal features and advantages of the invention will become apparent to those skilled in the art upon review of the following drawings, the detailed description and the appended claims.

BRIEF DESCRIPTION OF THE DRAWINGS

The present invention will become more fully understood from the following detailed description, taken in conjunction with the accompanying drawings, wherein like reference numerals denote like elements, in which.

DETAILED DESCRIPTION OF A PREFERRED EXEMPLARY EMBODIMENT

Figure 4:
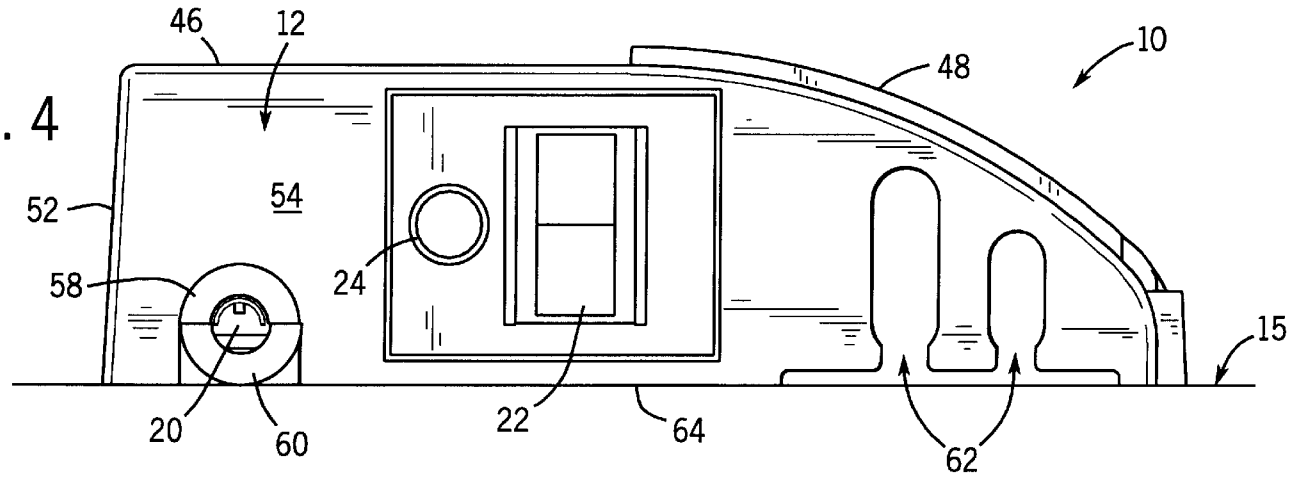
FIG. 4 is a left side view of the electrical connector illustrated in FIG. 1.

Referring generally to FIGS. 1–6, an exemplary electrical connector 10 in accordance with a preferred embodiment of the present invention is illustrated. The connector 10 generally includes a cover 12 attached to a base 14 (FIGS. 2 and 5) by a plurality of fasteners (not shown). The connector 10 is configured to be placed on a planar surface 15, such as the ground or a floor. The connector 10 also includes a contact housing plate 16 and a contact housing cover plate 18 disposed between the base 14 and the cover 12. A power cord 20, which extends from a side of the cover 12, supplies power to the connector 10 when coupled to a main power source (not shown). The connector 10 further includes a power switch 22 and a circuit breaker 24 (FIG. 4).

Figure 2:
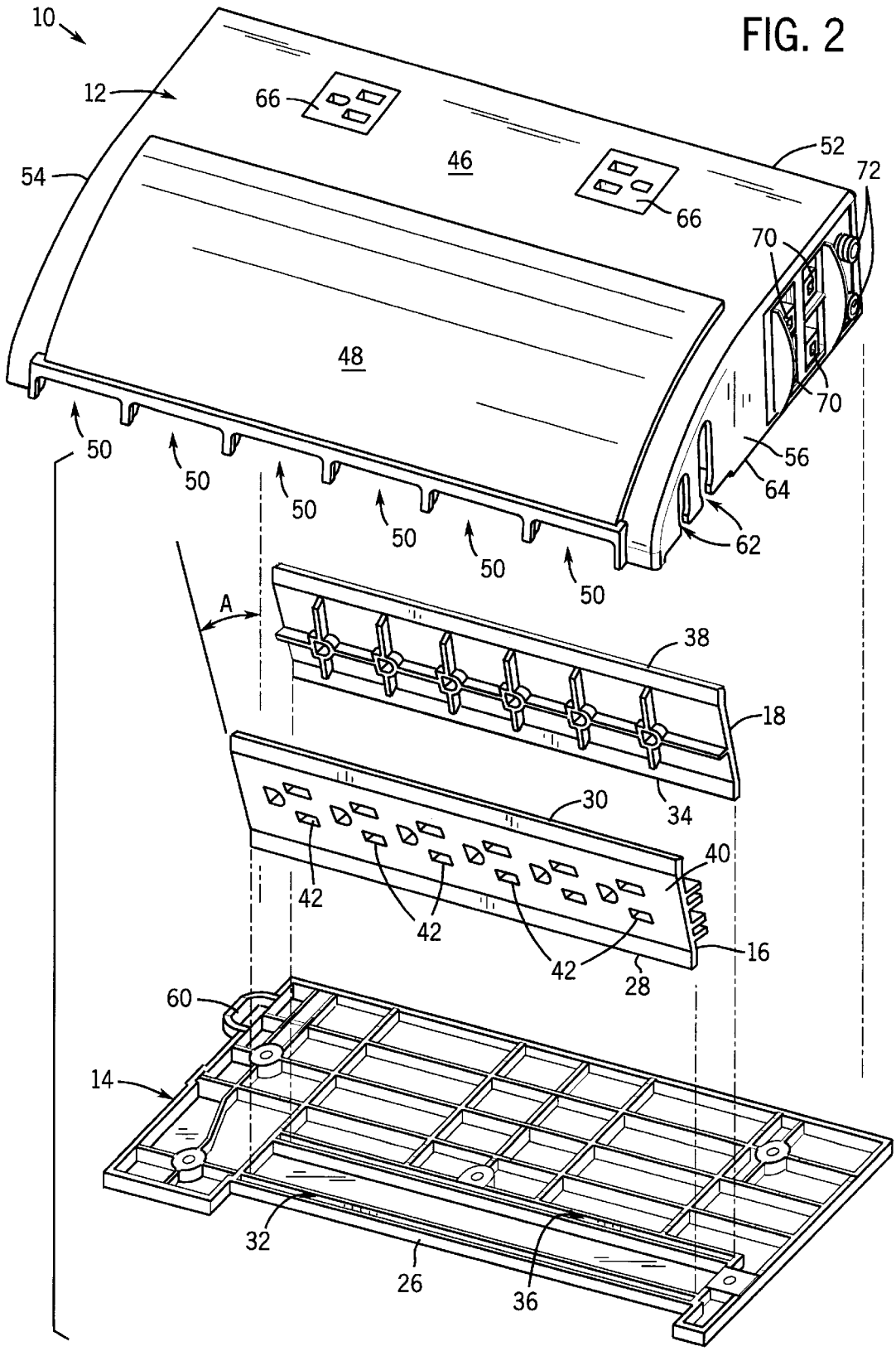
FIG. 2 is an exploded view of the electrical connector illustrated in FIG. 1, showing a cover, a contact housing plate and cover plate, and a base.
Figure 3:
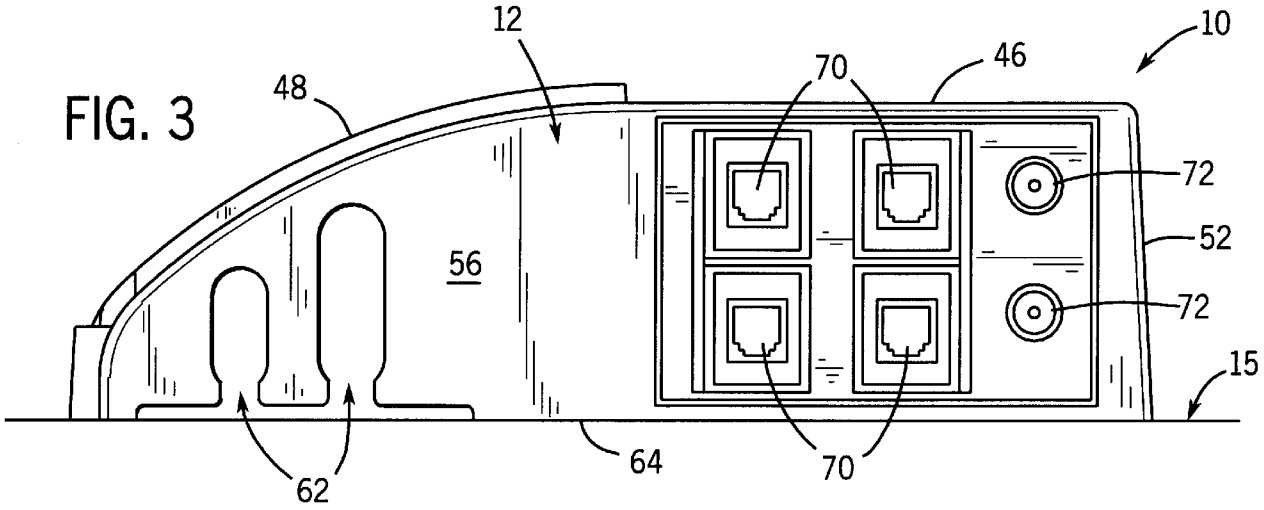
FIG. 3 is a right side view of the electrical connector illustrated in FIG. 1.

Referring to FIG. 2, the base 14 is generally rectangular and has a front edge 26 along which the contact housing plate 16 is disposed. The contact housing plate 16 has a bottom edge 28 and a top edge 30. The bottom edge 28 is received in a groove 32 formed in the base 14. The cover 12 has a groove (not shown) for receiving the top edge 30 of the contact housing plate 16. The contact housing cover plate 18, which is located behind the contact housing plate 16, is similarly connected to the connector 10; a bottom edge 34 of the contact housing cover plate 18 is received in a groove 36 formed in the base 14, and a top edge 38 is received in a groove 37 (FIG. 6) formed in the cover 12.

The contact housing plate 16 has a front face 40, along which a plurality of electrical receptacles 42 are formed therein. Each electrical receptacle 42 is adapted to receive an electrical plug (not shown). The plug is a conventional two or three prong electrical plug and is attached to an appliance (not shown) by an associated cord 44. The contact housing plate 16 is coupled to the base 14 such that the front face 40 is inclined at an angle A with respect to a line perpendicular to the base 14. The angle A is preferably ten degrees but may be greater. The orientation of the front face 40 of the contact housing plate 16 directs the cord 44 toward the planar surface 15, so that the cord 44 may lay flat on the planar surface 15 closer to the base 14 when the plug is coupled to the connector 10. Thus, when the plugs are coupled to the connector 10, the cords provide further stability to the connector 10 by supporting the base 14 on the ground. In addition, since the cords contact and rest on the planar surface 15 close to the connector 10, they are less likely to be bent or damaged or to form dangerous loops on which a person may trip.

Figure 5:
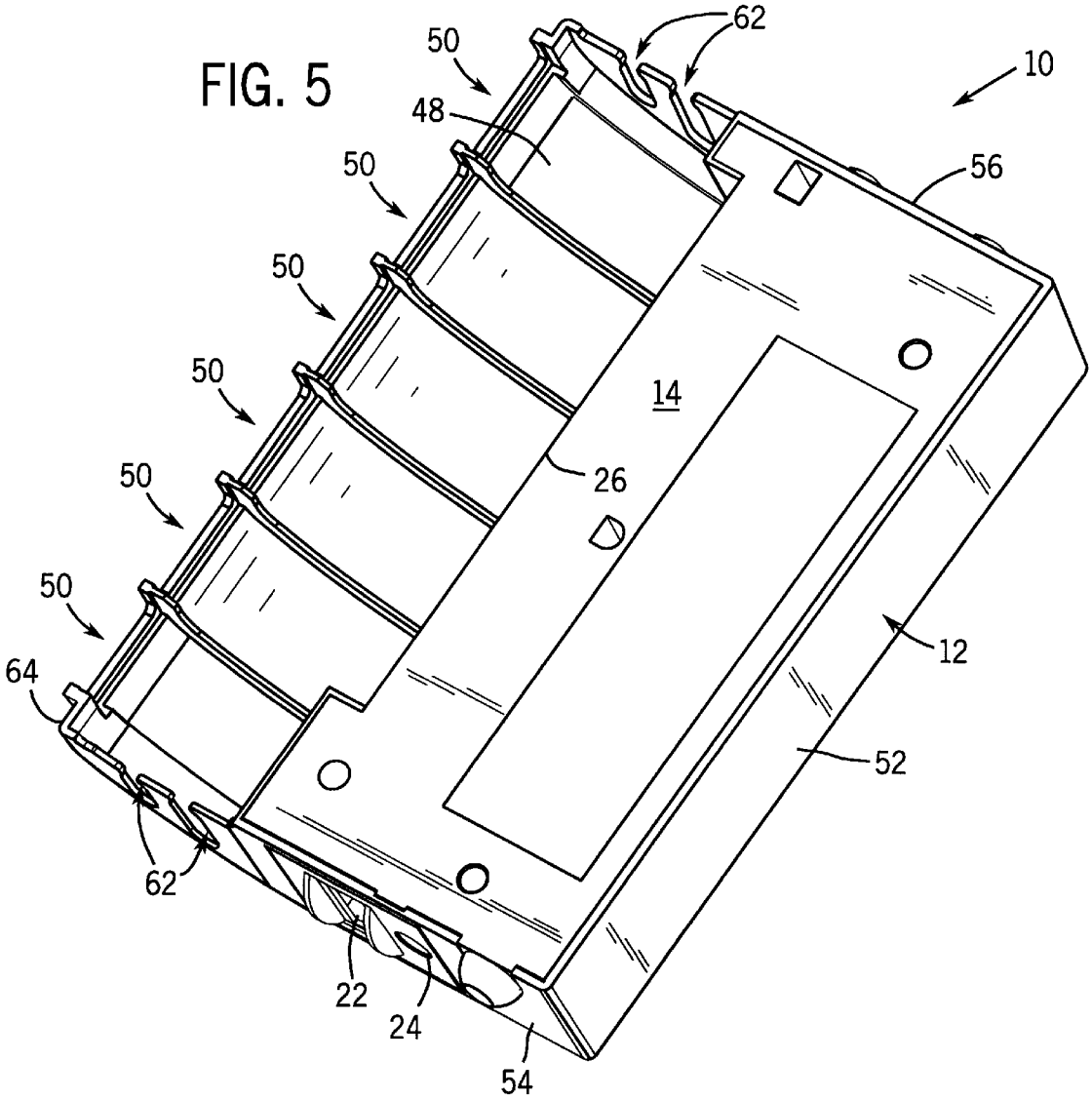
FIG. 5 is a bottom perspective view of the electrical connector illustrated in FIG. 1.

The cover 12 includes a planar top surface 46 and an inclined surface 48 extending out from the top surface 46 and down toward the base 14. When the cover 12 is attached to the base 14, the inclined surface 48 overlies the front edge 26 of the base 14 (FIG. 5). The inclined surface 48 includes openings 50 which provide an exit for the cords 44 whose prongs are engaged with the receptacles 42. Thus, the receptacles 42 are recessed in the cover 12, which shields them from unwanted debris and also protects the connections between the plugs and the receptacles 42 from being dislodged, bent or broken.

In addition to the inclined surface 48, the cover 12 also includes a back wall 52 and side walls 54 and 56. The back wall 52 is a substantially vertical surface that enables the connector 10 to abut a wall or other baseboard (not shown). The vertical, back wall 52 is beneficial for at least two reasons. First, the vertical, back wall 52 allows the connector 10 to be placed out of the way against a wall 53 (FIG. 1), such as underneath a desk. Second, the vertical, back wall 52 provides stability to the connector 10 by enabling the connector 10 to lean against a baseboard or wall.

Figure 6:
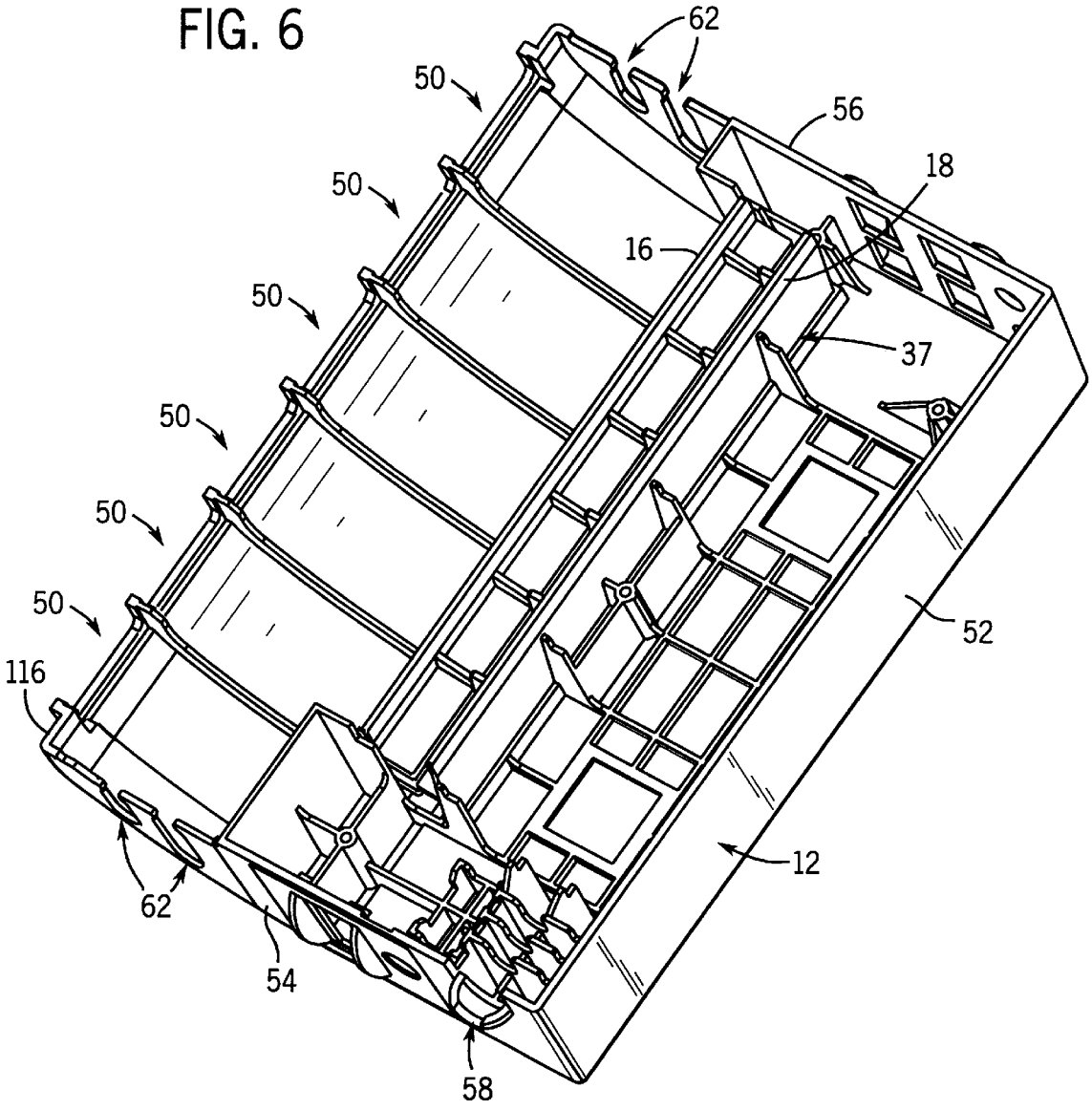
FIG. 6 is a bottom perspective view of the cover with the contact housing plate and cover plate attached.

As best illustrated in FIGS. 4 and 6, the side wall 54 has a groove 58 formed therein which cooperates with a groove 60 in the base 14 to provide an opening for the power cord 20. A plug associated with the power cord 20 (see FIG. 4) may also include a GFCI circuit. Since the power cord 20 projects from the base 14 of the connector 10, the power cord 20 rests almost completely on the planar surface 15, eliminating any unwanted loops which may be tripped on, thereby dislodging or disconnecting the connector 10 from the main power source. As will be appreciated by one skilled in the art, the electronic components of the connector 10, including a circuit board with surge suppression, are standard in the industry and therefore will not be discussed herein.

In addition, the side walls 54 and 56 have slots 62 which extend from a bottom surface 64 of the cover 12. While the slots 62 of the connector 10 are shown as being oblong, the slots 62 may also be circular, rectangular or any other appropriate shape. Each of the slots 62 is configured to receive one or more of the cords 44. Thus, when the plug is coupled to the connector 10, its associated cord 44 may extend either from the front of the connector 10, through one of the openings 50 of the inclined surface 48, or from the side of the connector 10, through one of the slots 62 in the side wall 54 or 56. When the cord 44 is received in one of the slots 62 in the side wall 54 or 56, the cord 44 is directed parallel to the wall or baseboard against which the vertical, back wall 52 rests. The openings 50 and the slots 62 enable a user to arrange the cords 44 in an orderly manner, thereby preventing entanglement.

Figure 1:
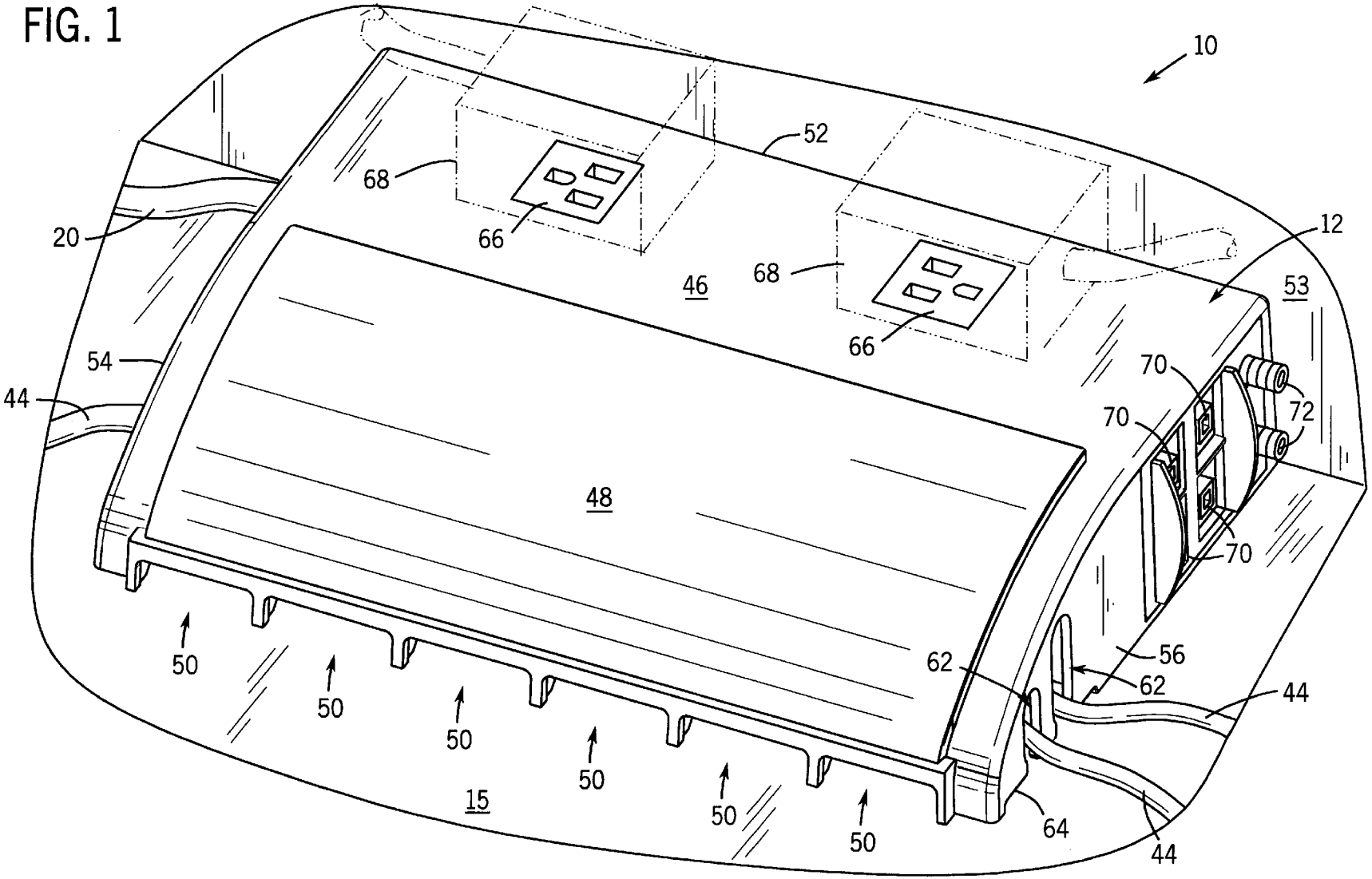
FIG. 1 is a perspective view of an electrical connector in accordance with a preferred embodiment of the invention.

As shown in FIG. 1, the connector 10 includes additional features such as outlets 66 located on the top surface 46 of the cover 12 for attaching a transformer 68 of an electronic device (shown in phantom in FIG. 1). When not in use, the outlets 66 are preferably covered by debris covers (not shown) to prevent dust and dirt from entering the outlets 66. The side wall 56 also includes telephone jacks 70 and coaxial connector plugs 72 for connecting additional devices.

Figure 7:
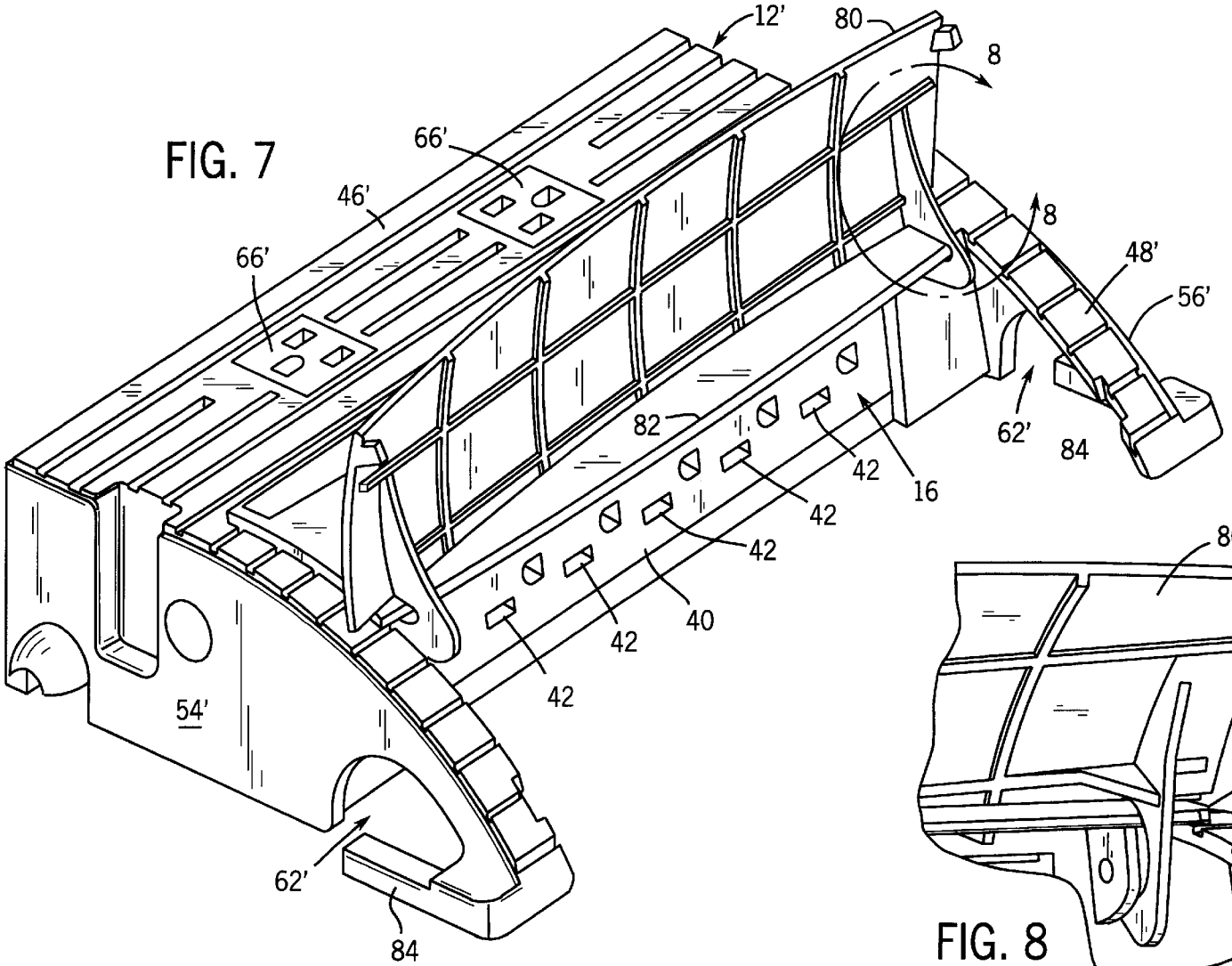
FIG. 7 is a perspective of the electrical connector illustrated in FIG. 1 showing a hinged door in an open position for accessing the outlets.
Figure 8:
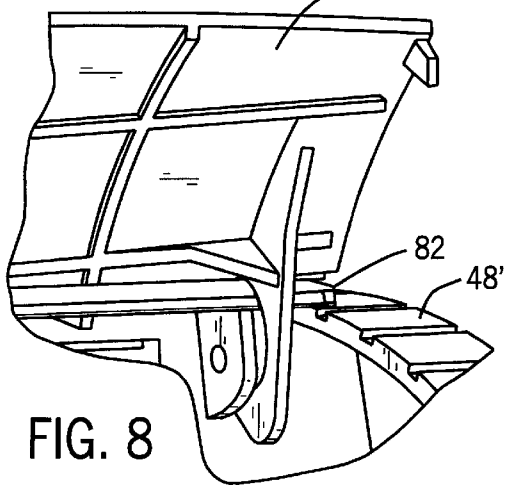
FIG. 8 is a sectional view taken generally about the arc 8—8 of FIG. 7.

Turning now to FIGS. 7 and 8, an alternative cover 12' is shown for the electrical connector 10. The cover 12' is generally similar to the cover 12, however, the inclined surface 48' of the cover 12' includes a movable lid 80. The lid 80 is coupled to the inclined surface 48' and is movable between an open position, in which the electrical receptacles 42 of the contact housing plate 16 are exposed, and a closed position (not shown). In the closed position, the lid 80 conceals the contact housing plate 16 like that of cover 12 shown in FIG. 1.

In this preferred embodiment of the cover, the lid 80 is hinged to the inclined surface 48' at a top edge 82. The lid 80 is snap fit in both the open and closed positions to prevent accidental release of the lid 80 from the desired position. Thus, the lid 80 facilitates use of the electrical connector 10 by providing better access to the electrical receptacles 42 of the contact housing plate 16. Once a plug is coupled to an electrical receptacle 42, the lid 80 is moved to the closed position in which it shields the connection from unwanted debris.

Also shown in the cover 12' of FIG. 7 are slots 62' in side walls 54' and 56'. Each slot 62' is semi-circular in configuration and receives the cords 44 (not shown in FIG. 7) of plugs engaged with the electrical receptacles 42. An extension 84, on which the cords 44 may rest, projects from side walls 54' and 56' and into slots 62'.

In summary, the electrical connector 10 overcomes the deficiencies discussed above. The connector 10 protects attached appliances from being fully or partially disconnected, by shielding the plugs and by directing the associated cords 44 to rest on the planar surface 15, thereby eliminating any unwanted loops. The stable, ramped shape of the connector 10 supports feet, chair legs or wheels, and other objects, such as vacuum cleaners, and enables them to pass over the cover 12 without tripping over or snagging the cords 44 or dislodging the plugs. A fully dislodged plug would disrupt the power supply to the appliance. A partially disconnected plug may become bent, disfigured or broken and may create electrical shock. The connector 10 also protects the plugs from being bent or damaged. In addition, the connector 10 includes cord management features which encourage the cords 44 to be organized neatly and to lie flat on the planar surface 15.

It will be understood that the foregoing description is of a preferred embodiment of this invention and that the invention is not limited to the specific form shown or described. For example, while the electrical connector includes six electrical receptacles, any number of receptacles may be provided. In addition, although the configuration of the electrical connector is substantially rectangular, the connector may also be pentagonal, hexagonal or any other shape. Finally, while the movable lid 80 is preferably hinged to the cover 12', the lid may also be slide coupled to the cover. These and other modifications may be made in the design and arrangement of other elements without departing from the scope of the invention as expressed in the appended claims.

What is claimed is:

1. An electrical connector comprising:

a base to be placed on a planar surface; a contact housing plate coupled to the base and having a front face and an electrical receptacle for engaging an electrical plug; and a cover coupled to the base and overlying the contact housing plate, the cover including a top surface and an inclined surface extending out from the top surface toward the base and having an opening therein forming a recess for receiving the electrical plug engageable with the electrical receptacle, the cover further including a lid connected thereto, the lid movable between an open position and a closed position, the open position facilitating access to the electrical receptacle.

2. The connector of claim 1, wherein the lid is pivotally connected to the cover.

3. The connector of claim 1, wherein the front face of the contact housing plate is inclined with respect to the base and directs a cord associated with the electrical plug toward the planar surface.

4. The connector of claim 3, wherein the front face is inclined at least 10 degrees from a line perpendicular to the base.

5. The connector of claim 1, wherein the contact housing plate has a plurality of electrical receptacles, and the inclined surface of the cover has a plurality of associated openings formed therein.

6. The connector of claim 1, wherein the cover has a planar top surface.

7. The connector of claim 6, wherein the planar top surface includes at least one outlet adapted to receive a transformer.

8. The connector of claim 1, wherein the cover has a vertical surface adapted to contact a vertical wall.

9. The connector of claim 1, wherein the cover includes at least one side wall having at least one slot formed therein and adapted to receive an electrical cord.

10. The connector of claim 1, further comprising a power cord, and wherein the base includes a groove for receiving the power cord.

11. The connector of claim 1, further comprising a contact housing cover plate mounted to the base.

12. An electrical connector comprising:

a base to be placed on a planar surface;

a contact housing plate coupled to the base and having a front face and an electrical receptacle for engaging an electrical plug; and a cover coupled to the base and overlying the contact housing plate, the cover including a vertical surface for contacting a vertical wall, a top surface and an inclined surface extending out from the top surface toward the base and having an opening therein forming a recess for receiving a cord associated with the electrical plug, and a lid coupled thereto and movable between an open position and a closed position, the open position facilitating access to the electrical receptacle.

13. The connector of claim 12, wherein the lid is pivotally coupled to the cover.

14. The connector of claim 12, wherein the front face of the contact housing plate is inclined with respect to the base and directs a cord associated with the electrical plug toward the planar surface.

15. The connector of claim 14, wherein the front face is inclined at least 10 degrees from a line perpendicular to the base.

16. The connector of claim 12, wherein the contact housing plate has a plurality of electrical receptacles, and the inclined surface of the cover has a plurality of associated openings formed therein.

17. The connector of claim 12, wherein the cover includes at least one side wall having at least one slot formed therein, the at least one slot adapted to receive an electrical cord.

18. An electrical connector comprising:

a base to be placed on a planar surface;

a contact housing plate coupled to the base and having a front face inclined with respect to the base and an electrical receptacle for engaging an electrical plug, the contact housing plate for directing a cord associated with the electrical plug toward the planar surface; and a cover coupled to and overlying the contact housing plate, the cover including a top surface, an inclined surface extending out from the top surface toward the base and having an opening therein forming a recess adapted to receive the electrical plug engageable with the electrical receptacle, the cover further including a lid pivotally connected thereto and movable between an open position and a closed position, the open position facilitating access to the electrical receptacle.

19. The electrical connector of claim 18, wherein the front face is inclined at least 10 degrees from a line perpendicular to the base.

20. The electrical connector of claim 18, wherein the contact housing plate has a plurality of electrical receptacles, and the inclined surface of the cover has a plurality of associated openings formed therein.

* * * * *